US005378248A

United States Patent [19]

Yang et al.

[11] Patent Number: 5,378,248

[45] Date of Patent: Jan. 3, 1995

[54] METHOD OF MANUFACTURING A MALLEABLE MATERIAL FOR CANDLES

[76] Inventors: Hung Y. Yang; Chin-Sheng Chen, both of P.O. Box 82-144, Taipei, Taiwan, Prov. of China

[21] Appl. No.: 75,730

[22] Filed: Jun. 14, 1993

[51] Int. Cl.[6] ..... C10L 5/00

[52] U.S. Cl. ..... 44/275; 106/268; 106/245

[58] Field of Search ..... 106/268, 245; 44/275

[56] References Cited

U.S. PATENT DOCUMENTS 668,095 2/1901 Elmquist ..... 106/268
1,280,129 10/1918 Cohen ..... 106/268
1,960,994 5/1934 Geller ..... 44/275
3,914,131 10/1975 Hutchison ..... 106/268

*Primary Examiner*—Karl Group
*Assistant Examiner*—Chris Gallo
*Attorney, Agent, or Firm*—Alfred Lei

[57] ABSTRACT

This invention relates to a method of manufacturing a malleable material for candles which includes the following steps: preparing 60% refined cera alba, 20% stearic acid, 10% thickening agent; mixing the refined cera alba with the stearic acid and melting the mixture at 100° C.-120° C. so as to mix them evenly; adding the vaseline into the mixture thereby forming a solid state material.

1 Claim, 1 Drawing Sheet

METHOD OF MANUFACTURING A MALLEABLE MATERIAL FOR CANDLES

BACKGROUND OF THE INVENTION

Candles were commonly made by repeated dipping in melted tallow, by pouring tallow or wax into molds, or by pouring beeswax over the wicks. Most modern candles are machine-made by a molding process, although candle making as an art survives in industrialized countries. However, The conventional candles have a fixed appearance and cannot be pressed into new shapes thus limiting the usage thereof.

Therefore, it is an object of the present invention to provide a method of manufacturing a malleable material for candles which may obviate and mitigate the above-mentioned drawback.

SUMMARY OF THE INVENTION

It is the primary object of the present invention to provide a method of manufacturing a malleable material for candles which may be pressed into a desired shape by the hands of an user.

It is another object of the present invention to provide a method of manufacturing a malleable material for candles which is easy to carry out.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
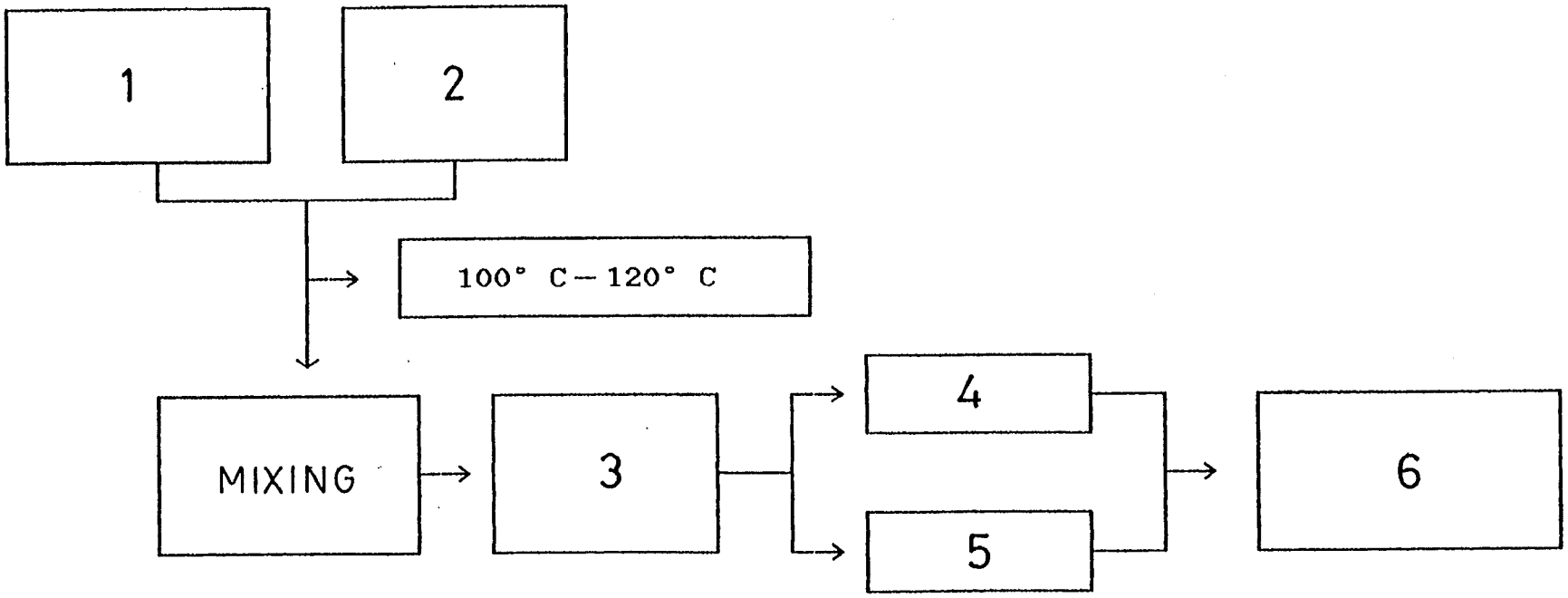
FIG. 1 shows a flow chart according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to FIG. 1, the method of manufacturing a soft material for candles according to the present invention mainly comprises the steps of:

1. preparing 60% refined cera alba 1, 20% stearic acid 2, 10% vaseline 4 or linseedpaint 5, and 10% thickening agent;

2. mixing the refined cera alba 1 with the stearic acid 2 and melting the mixture at 100° C.–120° C. so as mix them evenly;

3. adding the vaseline 4 into the mixture thereby forming a solid state material 6.

The vaseline 4 is used as a medium for static elasticity and heat.

When desired to make a candle, simply melt the material into liquid by heating, dispose the wick into a mold receiving the material, and cool the material to provide a solid candle.

When desired to modify the shape of the candle, one may rub the candle with his hands thereby providing heat to the candle and therefore softening the candle. Hence, the candle may be easily shaped as desired.

Further, the vaseline 4 may be replaced with the linseedpaint 5, but they must have the same quantity.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A method of manufacturing a malleable material for candles comprising steps of:

preparing 60% refined cera alba, 20% stearic acid, 10% petroleum jelly, and 10% thickening agent;

mixing the refined cera alba with the stearic acid and melting the mixture at 100° C.–120° C. so as to mix them evenly; and adding the petroleum jelly into the mixture thereby forming a solid state material.

* * * * *